US005511570A

United States Patent [19]

Noren et al.

[11] Patent Number: 5,511,570

[45] Date of Patent: Apr. 30, 1996

[54] WAREWASHER EMPLOYING INFRARED BURNER

[75] Inventors: Lars T. Noren; Doug Noren, both of Petaluma, Calif.

[73] Assignee: The Stero Company, Petaluma, Calif.

[21] Appl. No.: 322,929

[22] Filed: Oct. 13, 1994

[51] Int. Cl.[6] ..... B08B 3/10

[52] U.S. Cl. ..... 134/105; 134/106; 134/108

[58] Field of Search ..... 134/105, 106, 134/108; 68/15; 165/904, 148; 122/42, 43, 95.1, 235.32, 266

[56] References Cited

U.S. PATENT DOCUMENTS

| | | | |
|---|---|---|---|
| 1,624,982 | 4/1927 | Rosenberg | 134/105 X |
| 1,896,648 | 2/1933 | Thomas | 134/105 X |
| 2,483,709 | 10/1949 | Paulsen | 134/105 X |
| 2,614,571 | 10/1952 | Turpin | 134/105 X |
| 2,674,550 | 4/1954 | Dunlevy et al. | 134/105 X |
| 2,747,590 | 5/1956 | Ipsen | 134/105 |
| 3,407,025 | 10/1968 | Hardison . | |
| 3,571,939 | 3/1971 | Paul | 34/1 |
| 3,773,520 | 11/1973 | Longenecker . | |
| 3,915,180 | 10/1975 | Jacob | 134/58 |
| 4,439,242 | 3/1984 | Hadden | 134/25.2 |
| 4,492,185 | 1/1985 | Kendall et al. . | |
| 4,510,890 | 4/1985 | Cowan . | |
| 4,810,306 | 3/1989 | Noren | 134/25.2 |
| 4,993,402 | 2/1991 | Ripka . | |
| 5,375,563 | 12/1994 | Khinkis et al. . | |

*Primary Examiner*—Frankie L. Stinson
*Attorney, Agent, or Firm*—Thompson Hine & Flory

[57] ABSTRACT

The invention is a warewasher comprising a wash chamber, a tank at the bottom of the wash chamber, a heat exchange tube entering the tank through a first port in the tank, traversing the base of the tank, and exiting the tank through a second port. The tube is at a height such that it is submerged when the tank is filled with water. The tube has first and second ends outside the tank, and a gas-fired infrared burner located in the tube adjacent the first end to which a combustible fuel is supplied and combusted by the burner. The combustion products of the fuel are received in the tube and are vented at the second end. By combusting fuel and passing the combustion products through the tube, water in the tank is heated.

4 Claims, 5 Drawing Sheets

WAREWASHER EMPLOYING INFRARED BURNER

This invention relates to a commercial warewasher or dishwasher and, more particularly, to a gas-heated warewasher in which a heat exchange tube or tubes is immersed in the wash tank and the tank is heated by a gas-fired infrared burner.

BACKGROUND OF THE INVENTION

Domestic and commercial dishwashers vary significantly in their design and manner of use. In the commercial environment racks of dishes or other ware are successively washed and rinsed in rapid fashion over a very short time cycle, typically two to three minutes. There are various types of commercial dishwashers including conveyorized (rack conveyor machines, and rackless conveyor machines) and stationary rack washers (door machines). In terms of water temperature, commercial dishwashers are available as low temperature machines which employ chemical sanitizing agents and use rinse water of 130° F. and high temperature machines which use rinse water of 180° F.

Industry has taken a number of approaches to reduce the energy requirements of commercial dishwashers. However, the costs and disadvantages associated with these approaches often exceed or undesirably reduce the value of the energy savings. The primary industry solution in recent years or has been to emphasize low temperature machines with chemical additives. Sales of low temperature machines have increased substantially; but such low temperature machines are not without fault. A prime disadvantage is that the lower temperature of the foodware items at the time of removal from the warewasher makes it considerably more difficult for them to air dry than when rinsed at 180°. Greater heat in the items from a hot water sanitizing machine tends to drive off remaining moisture much faster.

SUMMARY OF THE INVENTION

The present invention provides a new approach to reducing the energy consumption of commercial dishwashers which is applicable to dishwashers of any of the aforementioned types but especially recirculating or tank dishwashers. In accordance with the invention a highly efficient commercial dishwasher is provided which utilizes a gas-fired infrared burner to heat the interior of a heat exchange tube which is submerged in the wash water tank.

One manifestation of the invention is a warewasher comprising a wash chamber, a tank at the bottom of said wash chamber for supplying heated water to said wash chamber, a heat exchange tube entering said tank through a first port in said tank traversing the base of said tank and exiting said tank through a second port, said tube being at a height in said tank such that said tube is submerged when said tank is filled with water, said tube having a first end and a second end located outside of said tank, a gas-fired infrared burner located in said tube adjacent said first end to which a combustible fuel is supplied and combusted by said burner, the combustion products of said fuel being received in said tube and vented at said second end wherein by combusting fuel and passing said combustion products through said tube, water in said tank is heated.

DESCRIPTION OF THE INVENTION

In "recirculating" or "tank" dishwashers, the tank is a relatively large reservoir which is originally filled with as much as 45 gallons of water which is reused in washing successive racks of dishes. A primary purpose for using the tank system is to provide a high volume of wash water on the dishes. In a typical recirculating or tank dishwasher, the water is heated by a heater, and acts as a heat sink to maintain water temperature. A fresh water dedicated "final rinse" is supplied to perform rinsing while the wash recirculation pump is off and/or the dishes have been conveyed past the "power wash" and/or "power rinse" sections and into the "final rinse" section. The final rinse system is used to carry only fresh water and not transport soiled wash water. A drain valve is located at the bottom of the tank. (Multiple drain valves may be used on multiple tank machines.) The valve is usually part of an open vertical standpipe which provides an overflow level near the top of the tank. A fresh water spray system rinses the rack of ware at the proper time in a cycle, after it has been washed by pumped recirculation of the large volume of wash water and rinse water. The final rinse water descends to the top of the pool of wash water, and a percentage of the final rinse water overflows through the standpipe and out to the drain. The tank itself is ordinarily drained only every few hours, at which time the water in the reservoir is usually fairly soiled. Strainer pans are provided to catch any large particles of food or other material washed from the dishes and keep them from recirculating through the pumped system. Detergent is replenished as needed. To drain the tank, the drain is opened, and in so doing the entire large volume tank is drained by gravity into at least one floor drain.

Figure 1:
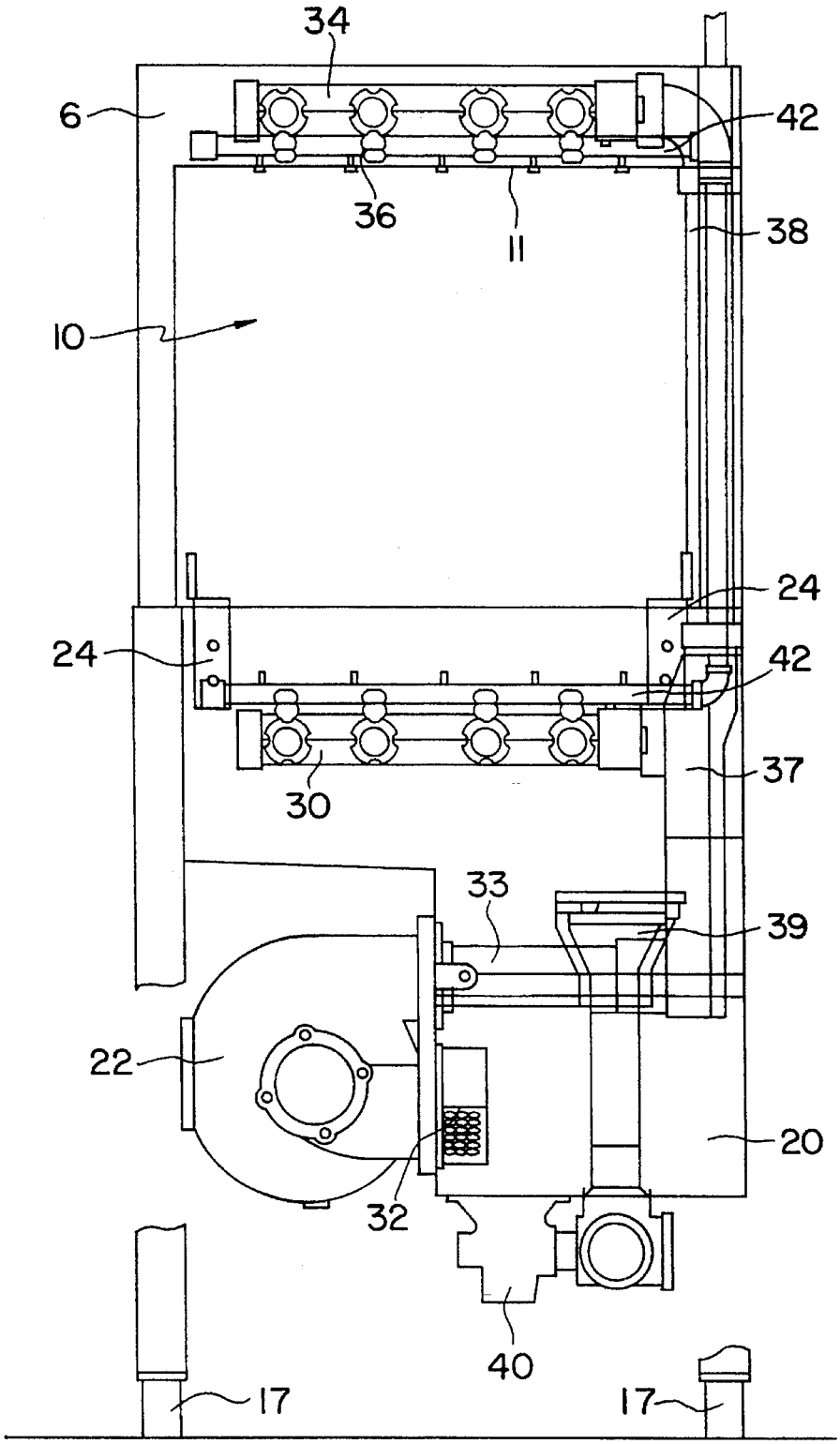
FIG. 1 is a front view of a dishwasher in accordance with the invention.
Figure 5:
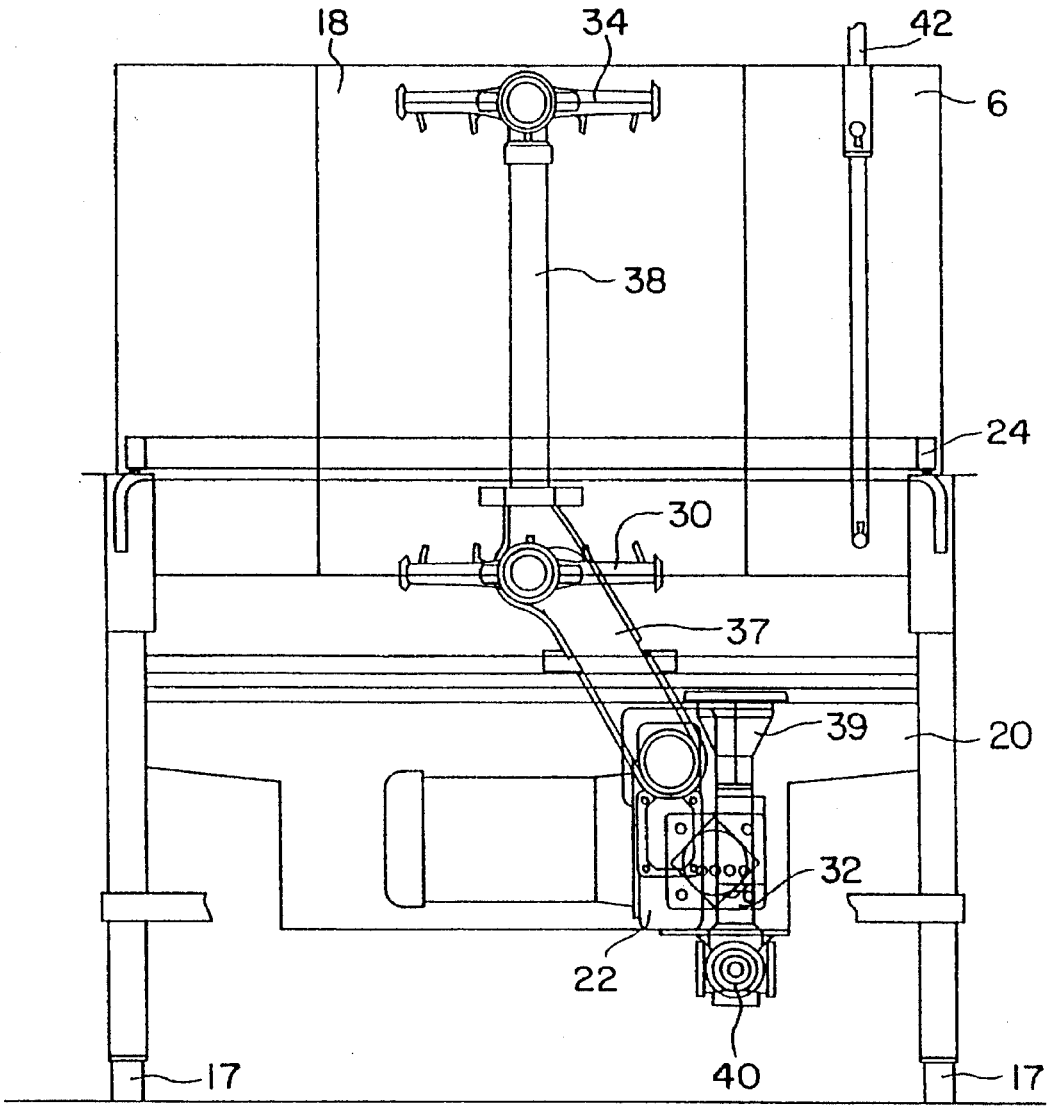
FIG. 5 is a side cross-sectional view of the warewasher of FIG. 1.

With certain exceptions which will be noted, the basic components of a dishwasher in accordance with the present invention are known. FIGS. 1 and 5 illustrate a front and side view of a conveyorized dishwashing machine includes a washing/rinsing chamber 10 which is defined by a hood 6, usually formed of stainless steel panels and components, and including a top wall 11, side walls 13, and a front inspection door 16. The hood is connected to a tank which is supported upon legs 17. At the bottom of the hood 6 is a wash tank 20 having a heat exchange tube 50 which is described in greater detail below.

Above tank 20, "tracks" 24 provide support for standard ware racks. The racks are loaded with ware on one side, conveyed, washed, rinsed, and sanitized, and then unloaded on the other side. Heated wash water, and rinse water (in multiple tank dishwashers) is drawn into the pump 22 at the bottom of the tank through the pump intake screen 32, pumped through the cross over pipe 33, into the lower elbow and tee assembly 37. From assembly 37, water is pumped out and onto the ware being conveyed through the dishwasher through at least one lower stationary wash arm 30, and up the standpipe 38, and out at least one upper stationary wash arm 34. The fresh hot rinse water supply line extends from a source of hot water (not shown) and is connected to the final rinse arms 42 including rinse spray heads 36. The main tank is typically filled with 40° F. water. The rinse line is supplied with 80° F. water. In some cases, the main tanks can be filled with 80° F. water from the same hot water line which feeds the rinse line.

An overflow 39 is situated in the tank so as to maintain a constant level of water in the tank and to allow fats and oils to be skimmed off of the surface of the water in the tanks. Drain 40 is provided at the bottom of the tank for removing the soiled wash and rinse water. A water level sensing device is located in the tank to provide the proper level of water for suitable operation, and low water detection.

Figure 2A:
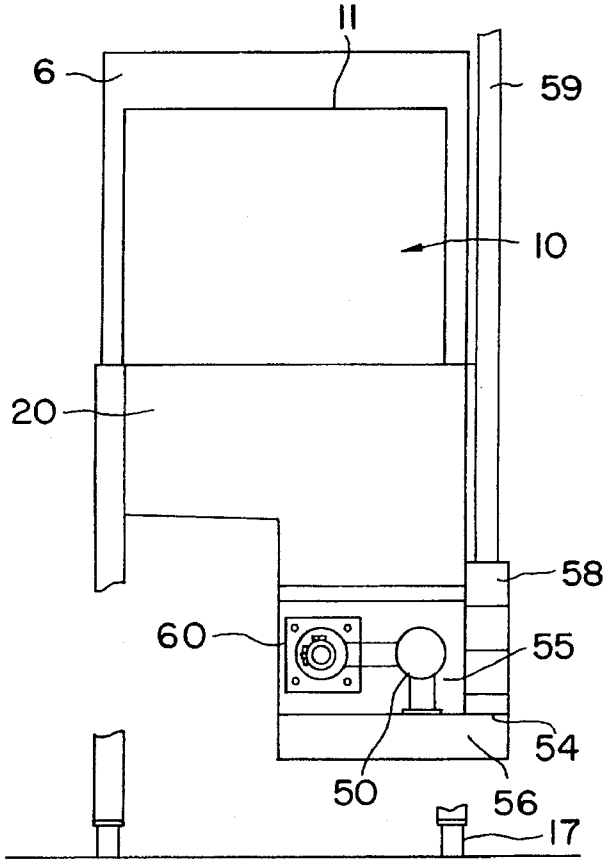
FIG. 2(A) is a cross-sectional view of the dishwasher showing the heat exchange tube.
Figure 2B:
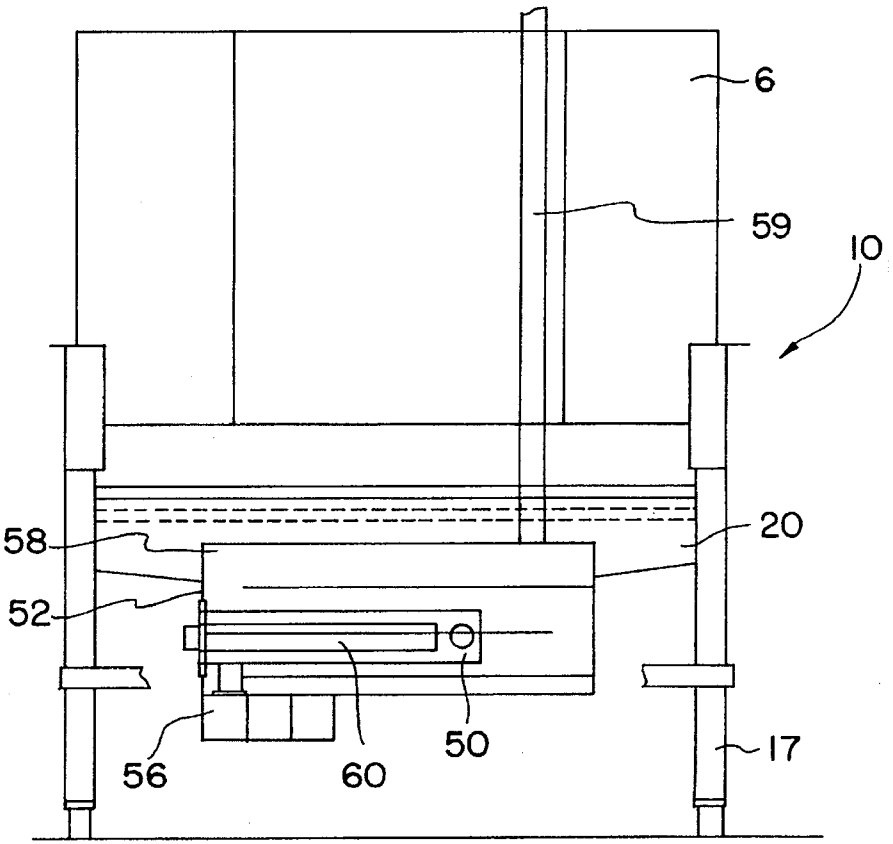
FIG. 2(B) is a side view of the tank and heat recirculation box in the dishwasher of FIG. 1.
Figure 3:
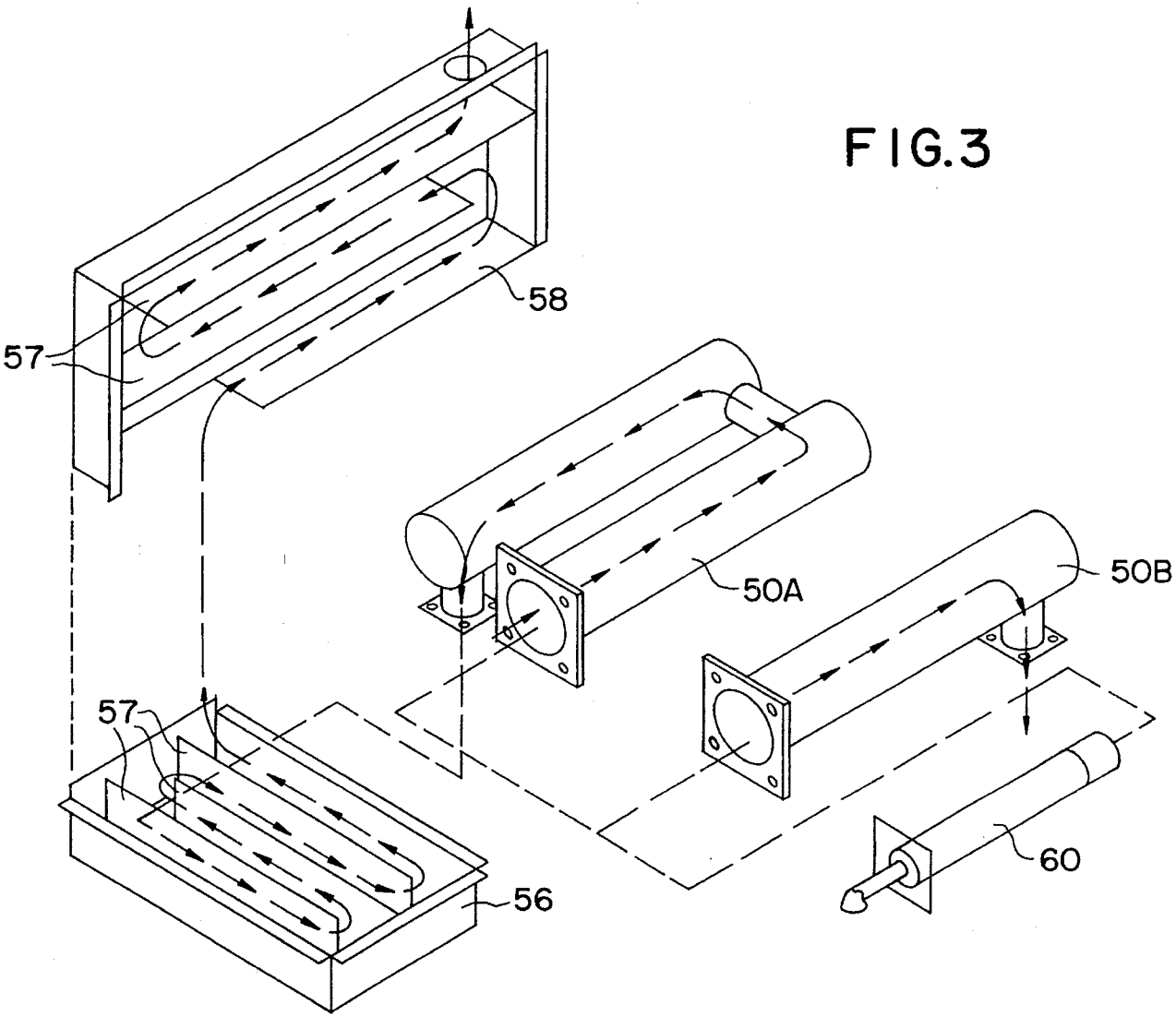
FIG. 3 is an exploded view of the heat tube and heat recirculation box showing the heat flow for the dishwasher of FIG. 1. whereby heat is generated

The heat exchange tube 50 is situated in the tank 20 as shown in FIGS. 2A and 2B such that it is submerged when the tank is filled with wash water. The tube 50 traverses the tank 20. The tube 50 may have any of a number of designs. Depending upon the capacity of the tank 20, the tube may traverse the tank one or more times. FIG. 2 illustrates a tube 50 which crosses the tank once. FIG. 3 illustrates the gas flow paths for an alternative U-shaped tube design 50A in which the tube crosses the tank twice and an alternative single tube design 50B. Other designs including serpentine configurations may also be useful.

The tube 50 enters the tank side through tank wall 52 and is vented through the bottom 54 of tank 20 through vertical pipe 55. From the bottom of the tank 54, the vented gases pass through a lower heat recirculation box 56 containing baffles 57 and into a side heat recirculation box 58 before they are vented via a small exhaust flue 59 to a standard ventilation system. Preferably, the heat recirculation boxes are designed such that the gases are cooled to a temperature of about 200° to 300° F. before they are vented to the outside atmosphere via an exhaust flue 59.

Figure 4:
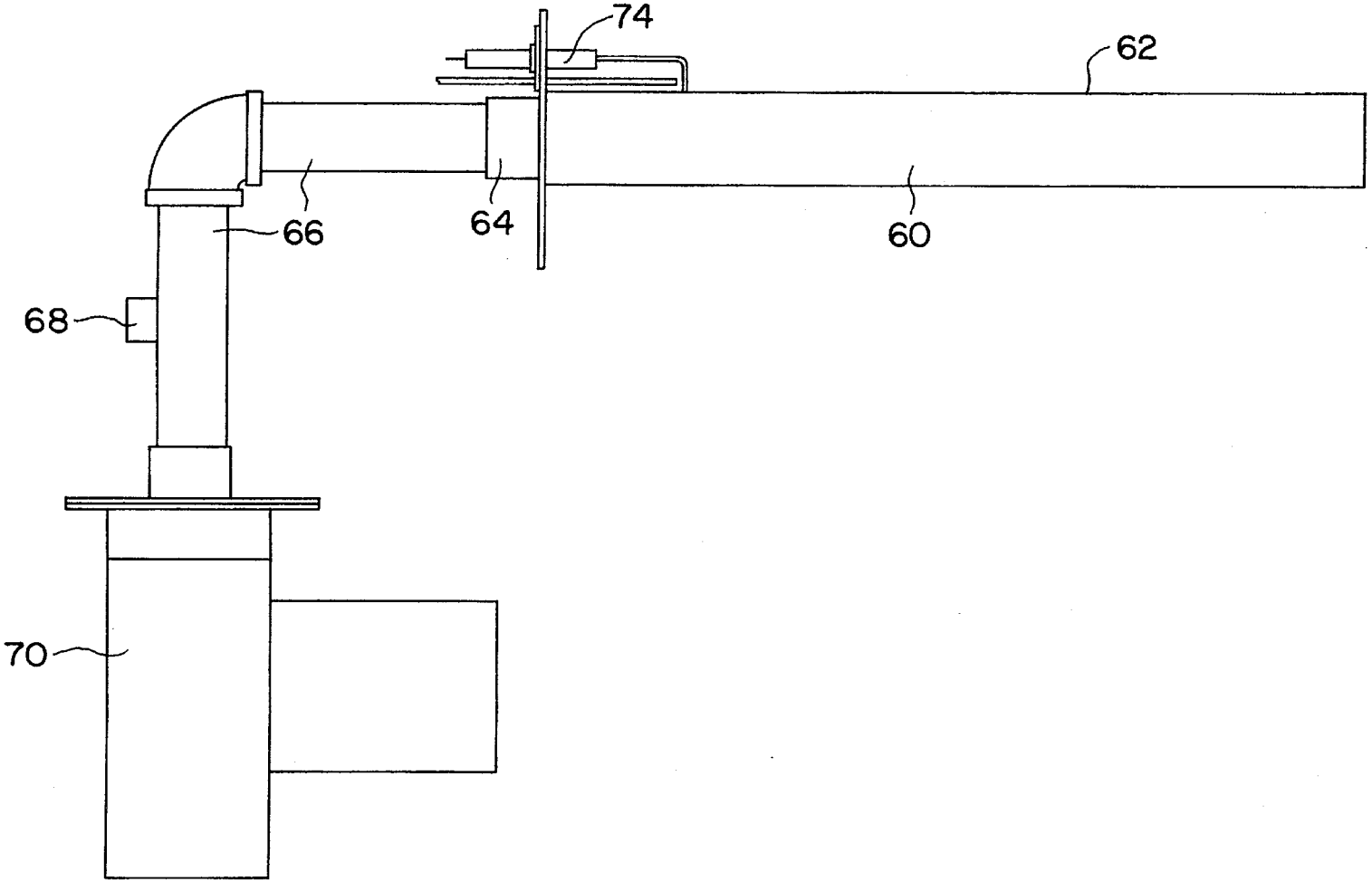
FIG. 4 is a side view of the infrared burner.

The heat source for the dishwasher of this invention is a unique infra-red burner. These burners heat the wash water primarily by infra-red radiation and convection currents, rather than conduction from a burning fuel. With attention to FIG. 4, a burner 60 is mounted in end 62 of burner tube 50. The source of fuel is preferably natural gas, or propane, and is admitted through a conduit 64. The conduit 64 is fed by a pipe 66 which is connected both to a source of gas at inlet 68 and flowing air from blower 70. The air pressure preferred is moderate and, typically a 1/25 horse power blower will be sufficient. The air gas mixture filters through the permeable surface of the burner cylinder 62 and is ignited, preferably by a hot surface igniter 74. Hot surface igniter 74 is a resistance type element which can achieve a very high temperature in a very short period of time. Such devices are available through, for example, Channel Products of Chesterland, Ohio. The igniters operate on a relatively low wattage and have the ability of igniting the burners without spark generation. Spark generation has been found to interfere with control apparatuses as is well known.

When ignited, the fuel air mixture then burns at the surface of the porous mesh cylinder 62 heating the surface to emit infra-red radiation within each burner tube 50. As noted above, then, the primary source of heat is via infra-red radiation, as well as convection currents.

Gas-fired infrared burners useful in the invention are commercially available. Tubular wire mesh, woven ceramic and ceramic plaque burners may be used. Useful burners are available from Solaronics, Inc. of Rochester, Mich. The burner will be selected based on tank size and the rate of gallons being recirculated. The 621622SC burner from Solaronics is particularly useful for heating approximately 20 gallon tanks, recirculating at 300 gallons/minute.

While the invention has been described in detail, those skilled in the art will recognize that numerous modifications and variations are possible without departing from the spirit and scope of the following claims.

What is claimed is:

1. A warewasher comprising a wash chamber, a tank at the bottom of said wash chamber for supplying heated water to said wash chamber, a heat exchange tube entering said tank through a first port in said tank traversing the base of said tank and exiting said tank through a second port, said tube being at a height such that said tube is submerged when said tank is filled with water, said tube having a first end and a second end located outside of said tank, a gas-fired infrared burner located in said tube adjacent said first end to which a combustible fuel is supplied and combusted by said burner, said tube further including a first tubular portion and a second tubular portion, said gas-fired infrared burner being located in said first tubular portion, said second tubular portion being smaller in diameter than said first tubular portion and being located downstream of said first tubular portion so as to produce a back pressure in said first tubular portion, the combustion products of said fuel being received in said tube and vented at said second end into a baffle box, said baffle box including a first portion underlying said tank and a second portion adjacent one side of said tank, wherein by combusting fuel and passing said combustion products through said tube, water in said tank is heated.

2. The warewasher of claim 1 wherein water in said tank is reused in successive wash cycles.

3. The warewasher of claim 1 wherein said infrared burner is a woven ceramic burner.

4. The warewasher of claim 1 wherein said tube further includes a third tubular portion, larger in diameter than said second tubular portion, and said first tubular portion, said second tubular portion, and said third tubular portion are arranged in a U-shape.

* * * * *

US005511570B1

REEXAMINATION CERTIFICATE (3312th)

United States Patent [19] [11] B1 5,511,570

Noren et al. [45] Certificate Issued Aug. 26, 1997

[54] WAREWASHER EMPLOYING INFRARED BURNER

[75] Inventors: Lars T. Noren; Doug Noren, both of Petaluma, Calif.

[73] Assignee: The Stero Company, Petaluma, Calif.

Reexamination Request:
No. 90/004,451, Nov. 13, 1996

Reexamination Certificate for:

| | |
|---|---|
| Patent No.: | **5,511,570** |
| Issued: | **Apr. 30, 1996** |
| Appl. No.: | **322,929** |
| Filed: | **Oct. 13, 1994** |

[51] Int. Cl.[6] ..... B08B 3/10
[52] U.S. Cl. ..... 134/105; 134/106; 134/108
[58] Field of Search ..... 134/105, 106, 134/108; 68/15; 165/904, 148; 122/42, 43, 95.1, 235.32, 266; 431/328, 329

[56] References Cited

U.S. PATENT DOCUMENTS 3,625,233 12/1971 Southard .

*Primary Examiner*—Frankie L. Stinson

[57] ABSTRACT

The invention is a warewasher comprising a wash chamber, a tank at the bottom of the wash chamber, a heat exchange tube entering the tank through a first port in the tank, traversing the base of the tank, and exiting the tank through a second port. The tube is at a height such that it is submerged when the tank is filled with water. The tube has first and second ends outside the tank, and a gas-fired infrared burner located in the tube adjacent the first end to which a combustible fuel is supplied and combusted by the burner. The combustion products of the fuel are received in the tube and are vented at the second end. By combusting fuel and passing the combustion products through the tube, water in the tank is heated.

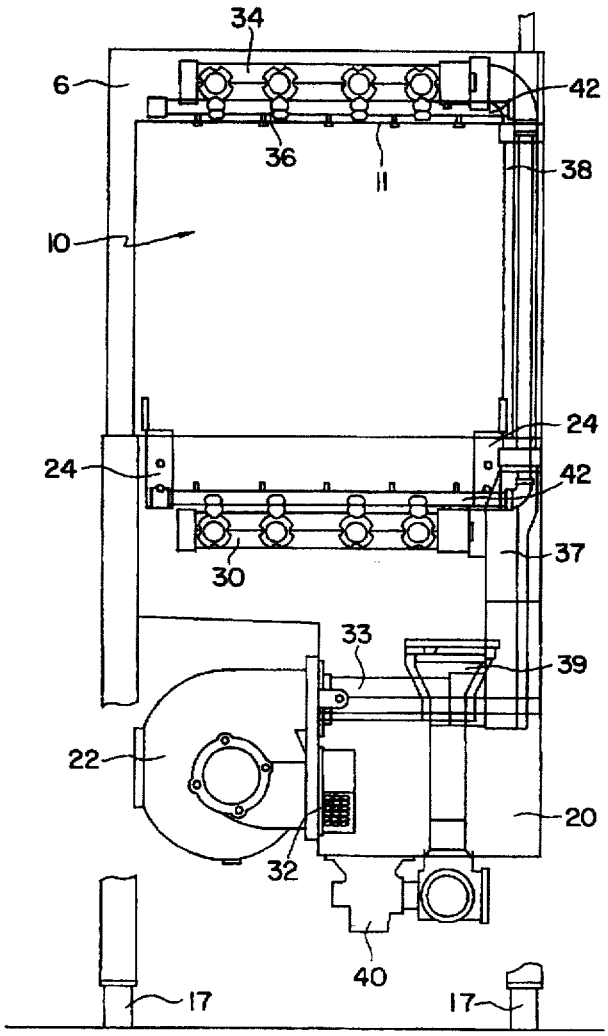

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–4 is confirmed.

* * * * *